US008215970B2

(12) United States Patent
Shamoto et al.

(10) Patent No.: US 8,215,970 B2
(45) Date of Patent: Jul. 10, 2012

(54) CONNECTOR

(75) Inventors: Wataru Shamoto, Yokkaichi (JP); Kenji Makino, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 13/050,109

(22) Filed: Mar. 17, 2011

(65) Prior Publication Data

US 2011/0230071 A1 Sep. 22, 2011

(30) Foreign Application Priority Data

Mar. 17, 2010 (JP) ..... 2010-061229

(51) Int. Cl.
*H01R 13/62* (2006.01)

(52) U.S. Cl. ..... 439/157

(58) Field of Classification Search ..... 439/157, 439/152, 342, 347, 345
See application file for complete search history.

(56) References Cited

U.S. PATENT DOCUMENTS

| | | | | |
|---|---|---|---|---|
| 5,681,175 | A * | 10/1997 | Busse et al. | 439/157 |
| 5,938,458 | A * | 8/1999 | Krehbiel et al. | 439/157 |
| 6,168,445 | B1 * | 1/2001 | Seutschniker et al. | 439/157 |
| 6,213,795 | B1 * | 4/2001 | Drescher et al. | 439/157 |
| 6,824,406 | B1 * | 11/2004 | Sharples et al. | 439/157 |
| 7,063,547 | B2 * | 6/2006 | Toyoda et al. | 439/157 |
| 7,121,866 | B2 * | 10/2006 | Testa et al. | 439/347 |
| 7,568,924 | B2 * | 8/2009 | Kinsey, Jr. | 439/157 |
| 7,568,925 | B2 * | 8/2009 | Ciriello et al. | 439/157 |
| 7,670,159 | B2 * | 3/2010 | Shamoto et al. | 439/157 |
| 2003/0109155 | A1 * | 6/2003 | Yamashita | 439/157 |

FOREIGN PATENT DOCUMENTS

JP 2003-223958 8/2003

* cited by examiner

*Primary Examiner* — Alexander Gilman
(74) *Attorney, Agent, or Firm* — Gerald E. Hespos; Michael J. Porco

(57) ABSTRACT

A connector has a housing (10) from the rear surface of which wires (200) are to be drawn out, and a cover (70) to be mounted on the housing (10) for specifying a draw-out direction of the wires (200) at a position facing the rear surface of the housing (10). A plurality of spaced apart legs (77) are formed on a peripheral portion of the cover (70) and project toward the housing (10) for engaging the housing (10). Spaces (60) for exposing the wire (200) drawn out from the rear surface of the housing (10) are defined between the legs (77) with the cover (70) mounted on the housing (10).

15 Claims, 13 Drawing Sheets

CONNECTOR

BACKGROUND OF THE INVENTION

1. Field of the Invention

The invention relates to a connector.

2. Description of the Related Art

Japanese Unexamined Patent Publication No. 2003-223958 discloses a conventional connector with a housing that is connectable to a mating housing. A cover is mounted on a rear end of the housing and a lever is mounted rotatably on the housing. Terminal fittings are accommodated in the housing, and wires connected to the terminal fittings are drawn out to the outside from the rear of the housing. The drawn-out wires are accommodated in the cover and are oriented in a direction substantially orthogonal to a connecting direction along a back plate of the cover.

Ribs are formed at four corners of the rear surface of the housing, and grooves are formed at four corners of the front opening edge of the cover. The cover is brought into contact with the housing in a direction substantially orthogonal to the rear surface of the housing and then is slid along the rear surface while fitting the ribs in the grooves to hold the cover on the housing.

The wires drawn out from the rear surface of the housing may be caught between the cover and the housing when the cover is mounted on and slid along the housing. As a result, efficiency may be deteriorated and surfaces of the wires may be damaged.

The invention was developed in view of the above situation and an object thereof is to prevent wires from being caught.

SUMMARY OF THE INVENTION

The invention relates to a connector with a housing that has a wire draw-out surface from which wires are to be drawn out. A restricting member is mounted on the housing and includes a restricting plate for specifying a draw-out direction of the wires at a position facing the wire draw-out surface. Spaced apart legs are formed on a peripheral portion of either the restricting member or the housing and project toward the other, and spaces are defined between the respective legs with the restricting member mounted on the housing for exposing the wires drawn out from the wire draw-out surface. The spaces prevent the wires from being caught between the restricting member and the housing.

The respective leg pieces may be formed on the restricting member to simplify the construction of the housing.

The restricting member may be slidable substantially along the wire draw-out surface of the housing.

The restricting member and the housing preferably are formed with slide portions that slide on the other sides while preventing the restricting member and the housing from being detached from each other when the restricting member is mounted.

The slide portions preferably are on the legs. Thus, the construction is simpler than if the slide portions and the legs were formed separately.

The connector preferably includes a substantially U-shaped movable member, such as a rotatable lever. The movable member preferably has a coupling and two arms that project from opposite ends of the coupling to straddle the housing. The housing is connected to a mating housing by displacing the movable member. The arms at least partly cover the spaces between the laterally adjacent legs when the coupling comes close to the housing to prevent foreign matter from entering the spaces A guide path is formed on the inner surface of the arm for guiding a displacement of the restricting member relative to the housing. The guide path preferably comprises: an assembly guide near the coupling and extending substantially straight forward from the rear end edge of a link of the arm portion, a slide permitting portion extending substantially from the front end of the assembly guide toward the front in the sliding direction of the restricting member and a mold removing portion extending substantially forward from an end of the slide permitting portion at the other widthwise side to the front end edge of the link. The assembly guide and the mold removing portion preferably at least partly overlap each other in the width direction.

These and other objects, features and advantages of the invention will become more apparent upon reading of the following detailed description of preferred embodiments and accompanying drawings.

DETAILED DESCRIPTION OF THE PREFERRED EMBODIMENTS

Figure 1:
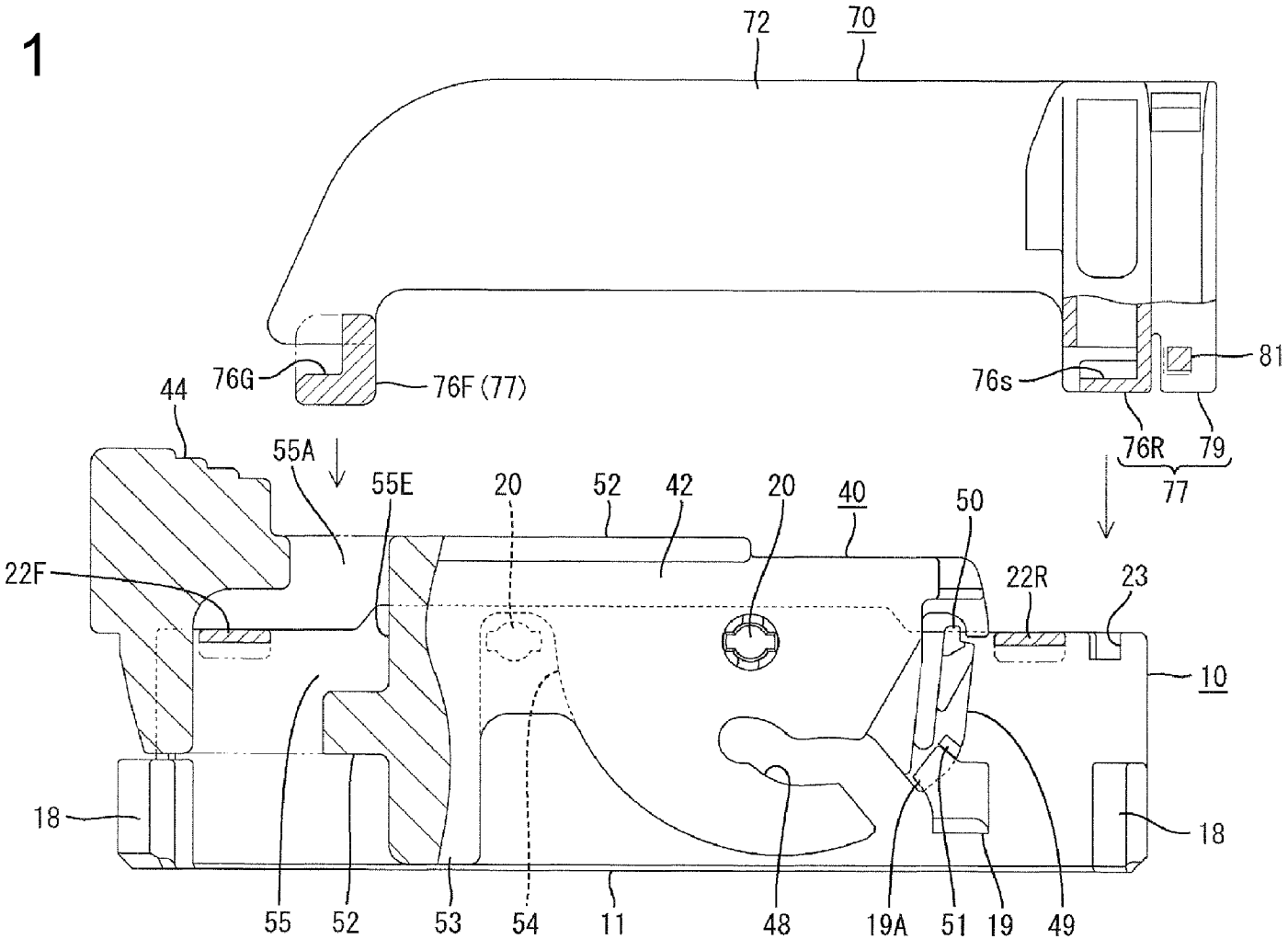
FIG. 1 is a plan view partly in section showing a state before a cover is mounted in a connector according to one embodiment of the invention.

A connector in accordance with a preferred embodiment of the invention is illustrated in FIGS. 1 to 13 and includes a housing 10, a lever 40 and a cover 70. The housing 10 is connectable to a mating housing 100. In the following description, ends of the housings 10, 100 to be connected to each other are referred to as the front ends.

Figure 5:
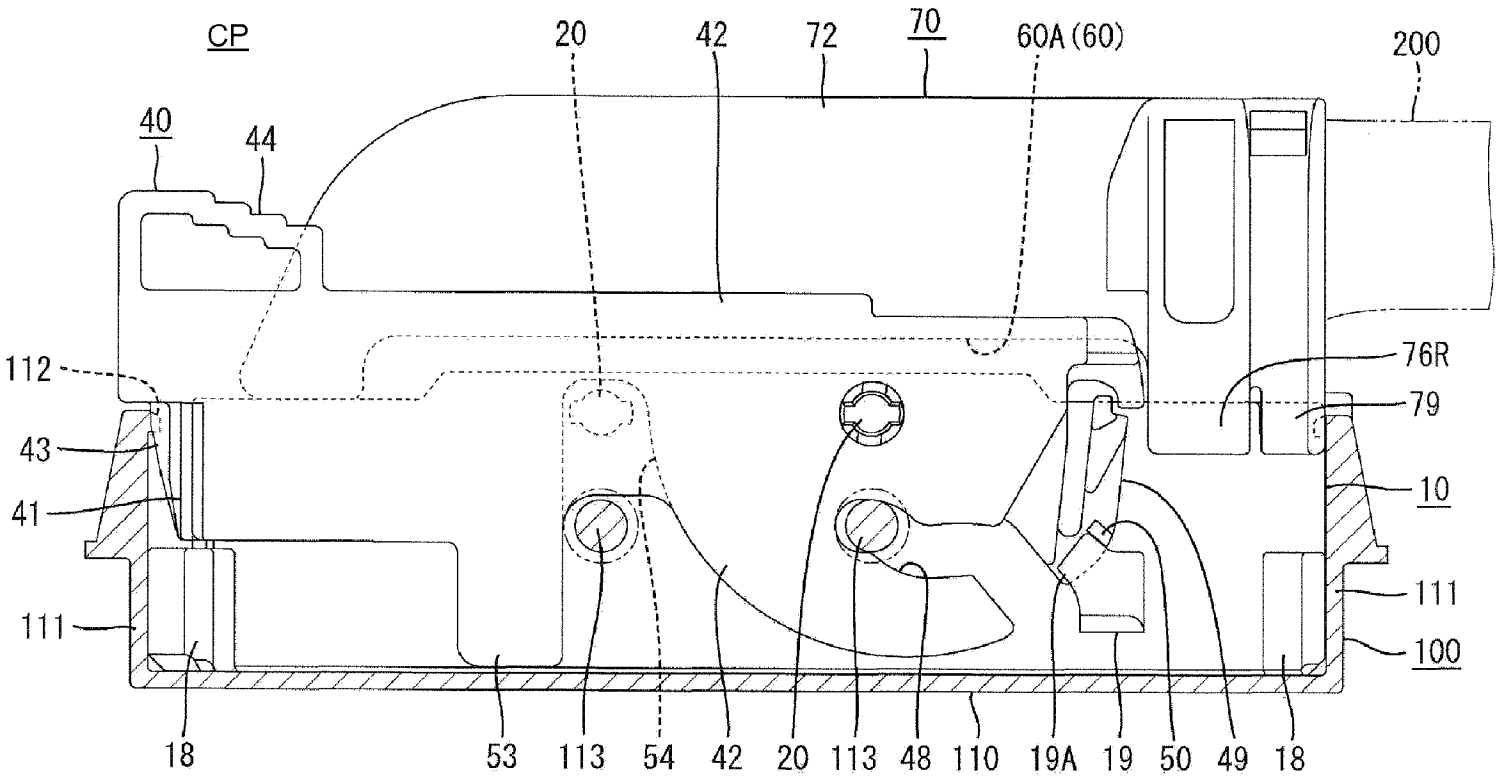
FIG. 5 is a plan view showing the lever at a connection position.
Figure 6:
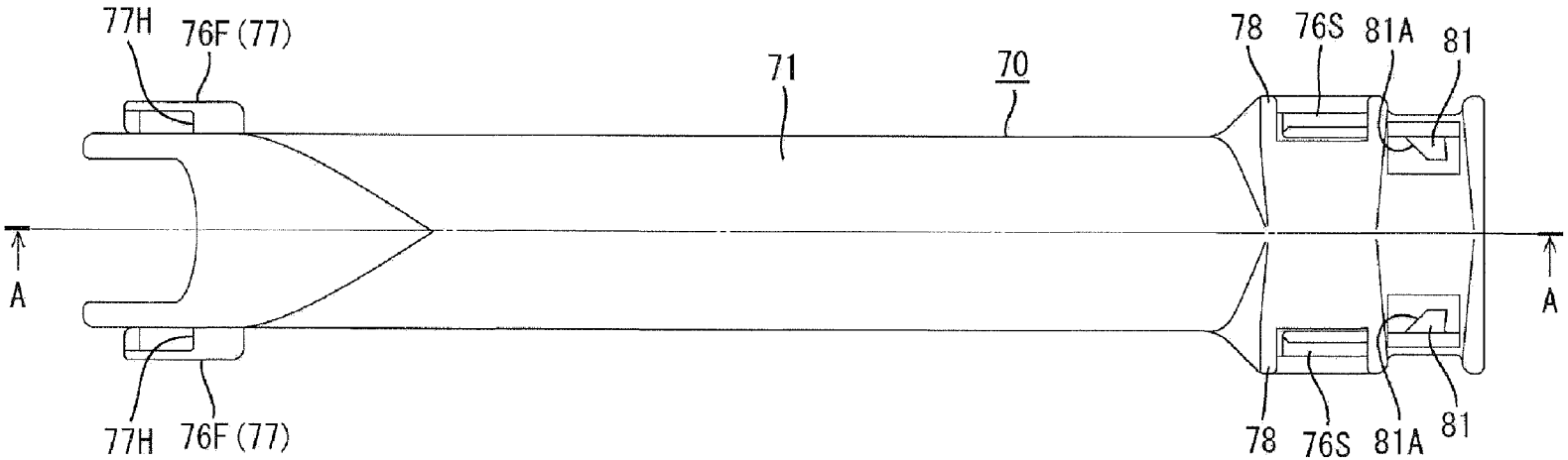
FIG. 6 is a plan view of the cover.
Figure 7:
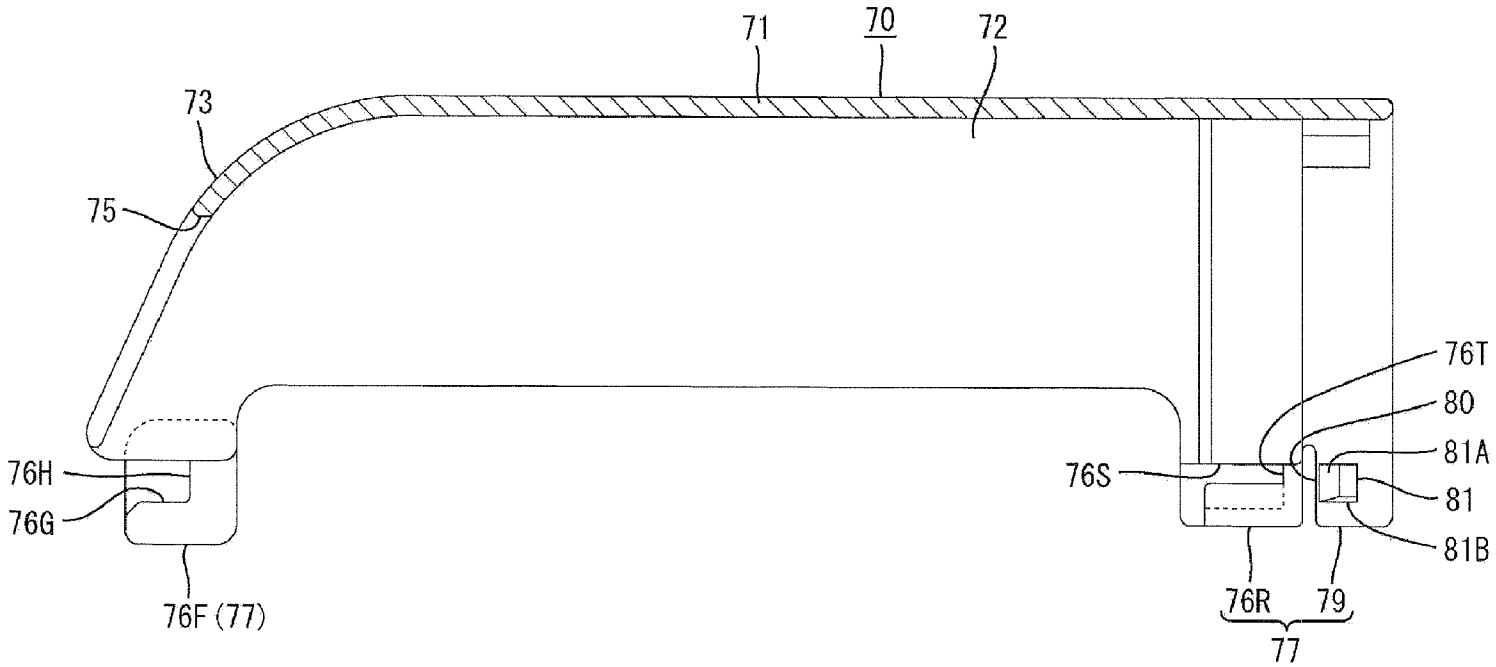
FIG. 7 is a section along A-A of FIG. 6.
Figure 8:
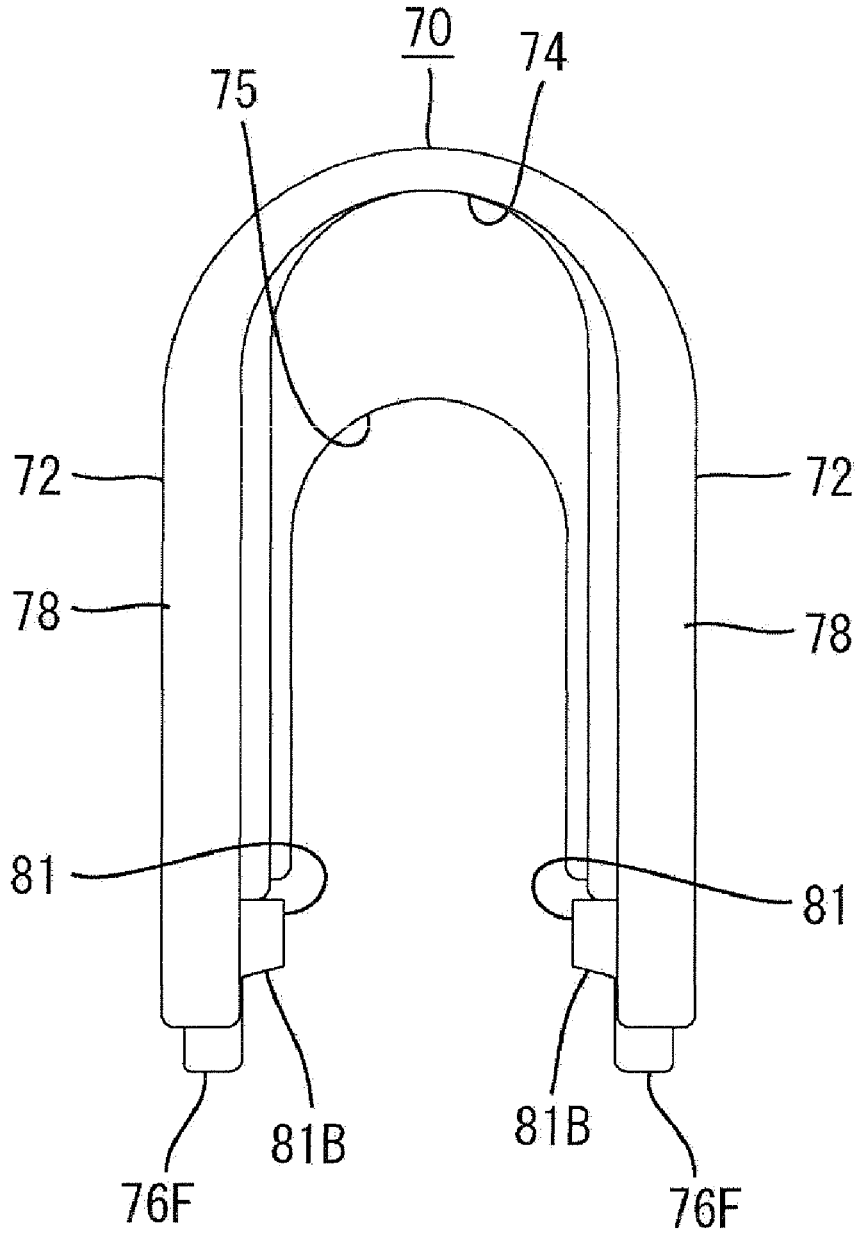
FIG. 8 is a right side view of the cover.
Figure 9:
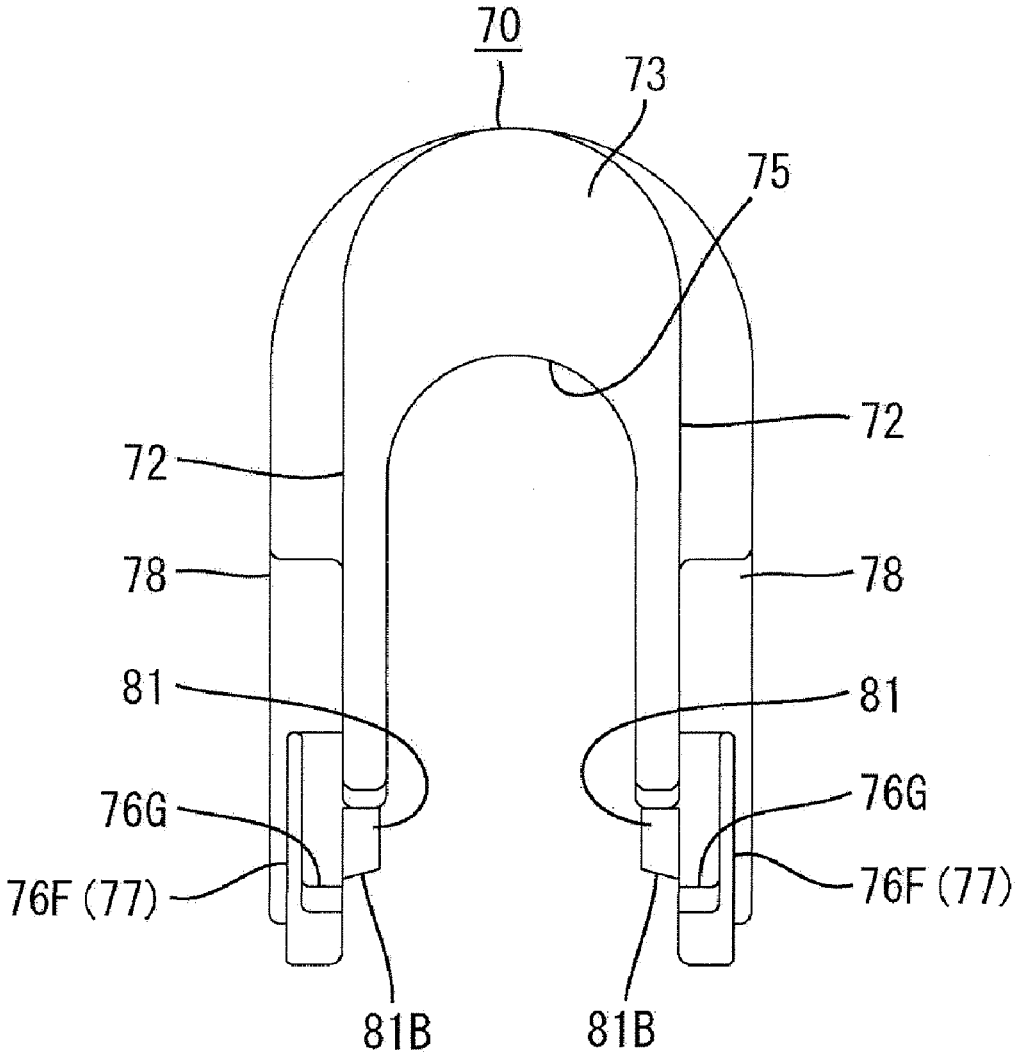
FIG. 9 is a left side view of the cover.

The mating housing 100 is made e.g. of synthetic resin and has a wide rectangular tubular receptacle 110, as shown in FIG. 5. The receptacle 110 has side walls 111 and engaging claws 112 project from inner surfaces of front ends of the side walls 111. Two substantially cylindrical cam followers 113 project on the inner surface of each of the upper and lower walls of the receptacle 11 at substantially opposite sides of a widthwise center. Unillustrated male tabs project into the receptacle 110.

Figure 10:
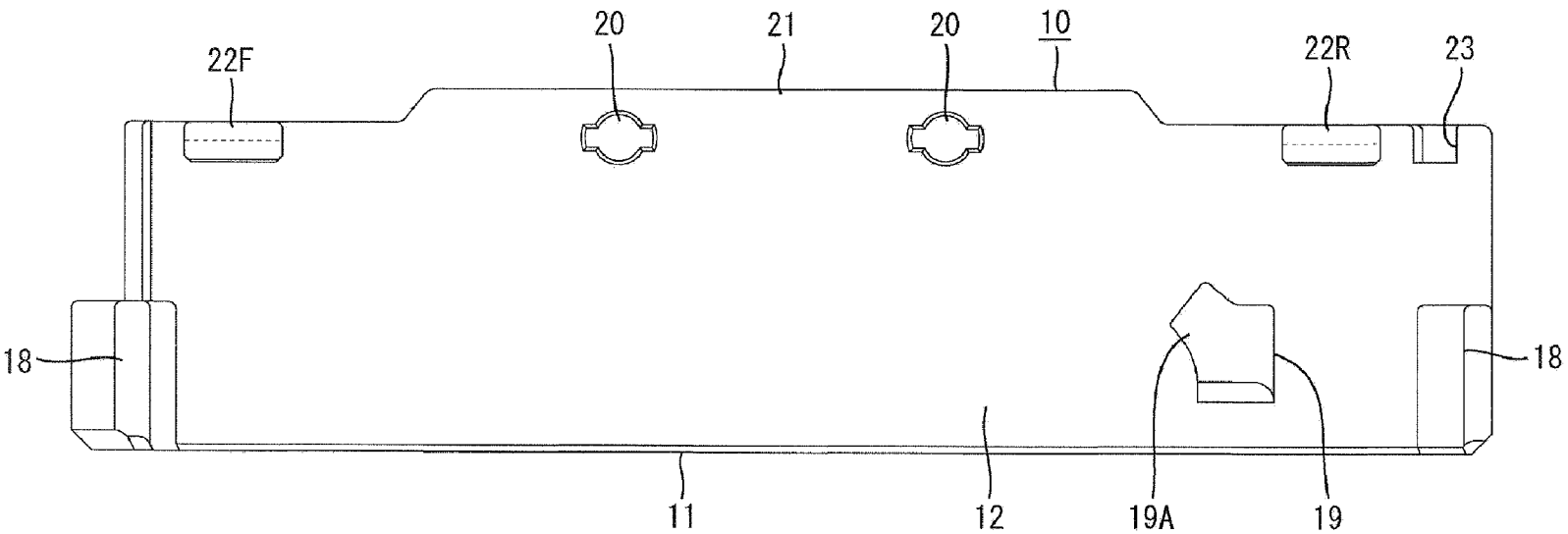
FIG. 10 is a plan view of a housing.
Figure 11:
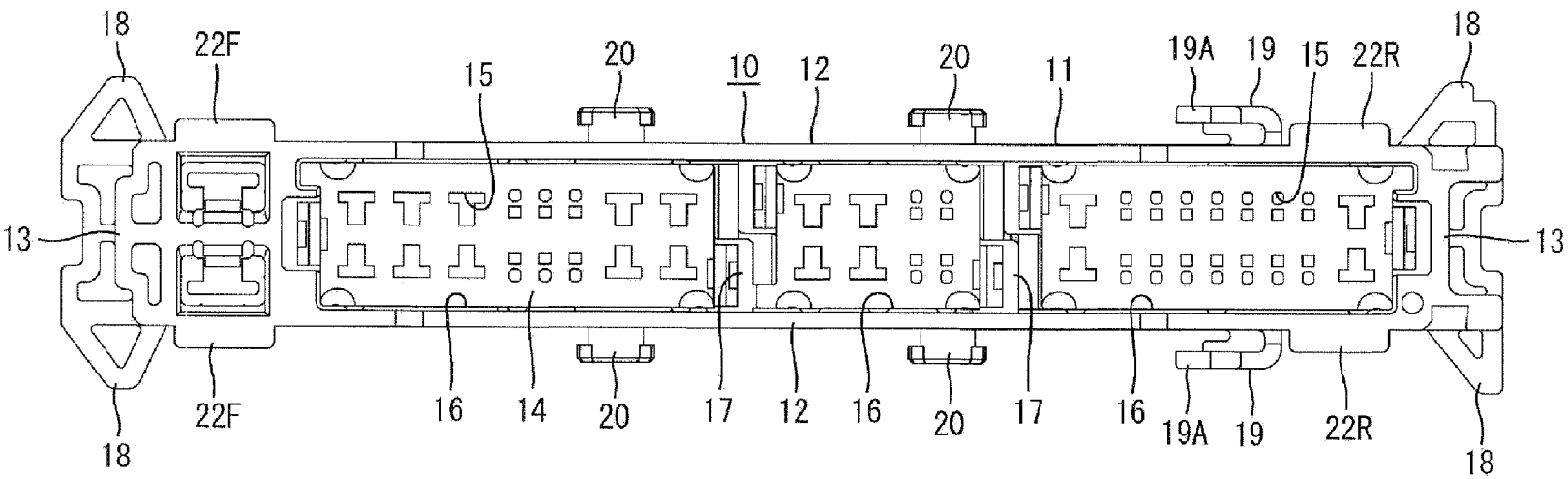
FIG. 11 is a rear view of the housing.

The housing 10 is made e.g. of synthetic resin and has a housing main body 11 substantially in the form of a wide rectangular box as shown in FIGS. 10 and 11. The main body 11 has long upper and lower walls 12 arranged along the width direction, short left and right walls 13 arranged along a height direction, a front wall 14 located at a front end and an open rear end. The front wall 14 has terminal insertion holes 15 through which the male tabs are inserted when connecting the two housings 10, 100. Sub-housing accommodating recesses 16 are formed side by side in the width direction in the main body 11, and partition walls 17 extend in the height direction between the respective sub-housing accommodating recesses 16. Sub-housings (not shown) are to be inserted into the respective sub-housing accommodating recesses 16 from behind. Female terminal fittings (not shown) are to be accommodated in the respective sub-housings. The respective female terminal fittings are connected to ends of wires 200, and the wires 200 are to be drawn out to the outside from the rear end surface of the housing 10.

Protrusions 18 are formed at opposite widthwise ends of front portions of the long walls 12. The respective protrusions 18 are ribs extending in forward and backward directions, and are inserted into unillustrated grooves of the mating housing 100 when the two housings 10, 100 are connected properly, but contact the front end edge of the receptacle 110 without fitting into the grooves during an attempt to connect the housings erroneously, thereby detecting an erroneously connected state of the housings 10, 100. At A hook 19 projects at a position near one widthwise end of the front of each long wall 12. The hook 19 includes a plate-like hooking piece 19A substantially parallel to the outer surface of the long wall 12.

Left and right substantially cylindrical shafts 20 project from each of the long walls 12 at positions near the rear end and at opposite sides of the widthwise center. A bulge 21 projects back from a widthwise intermediate part of the rear end of each of the long walls 12, and rear ends of the shafts 20 are supported on the bulge 21. Left and right housing slides 22F, 22R are formed at the rear end of each long wall 12 and are disposed so that the shafts 20 are between the housing slides 22F, 22R. The housing slides 22F, 22R are substantially L-shaped in section and are thin and long in the width direction of the long walls 12.

Locking cutouts 23 are formed at rear end portions of the long walls 12 in positions near the right short wall 13 and closer to the right housing slides 22R (more backward in the sliding direction SD), as shown in FIGS. 10 and 11. The first locking cutouts 23 are bottomed grooves having a rectangular plan view and are open at the rear end edges of the respective long wall 12.

Figure 12:
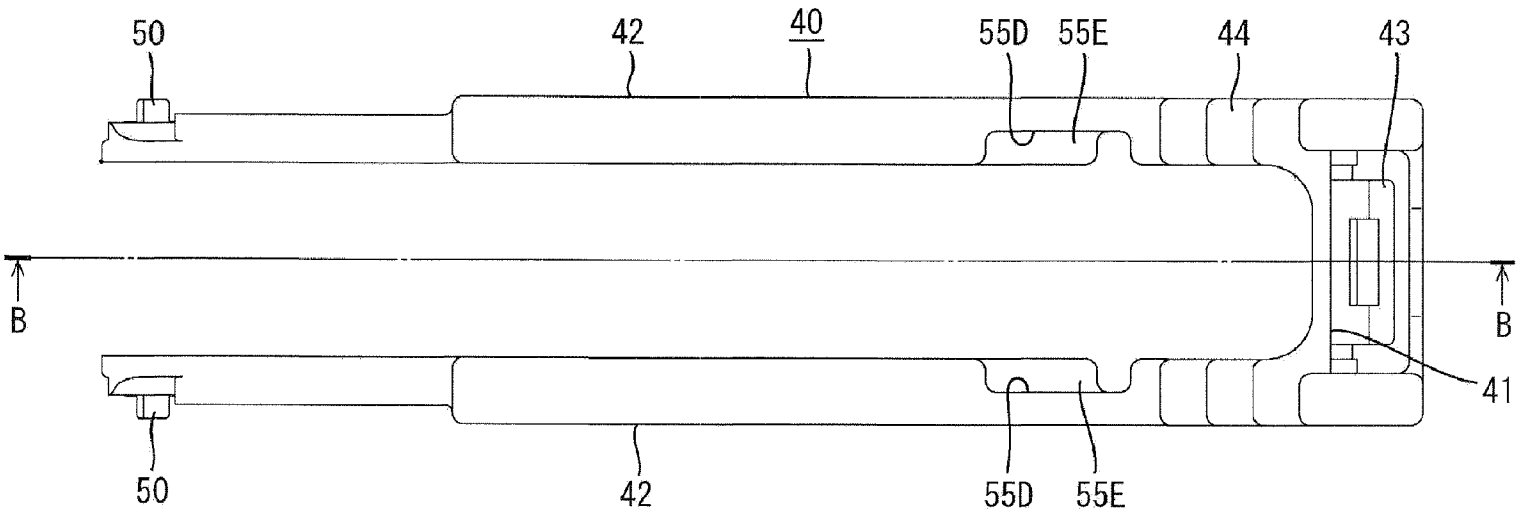
FIG. 12 is a side view of the lever.
Figure 13:
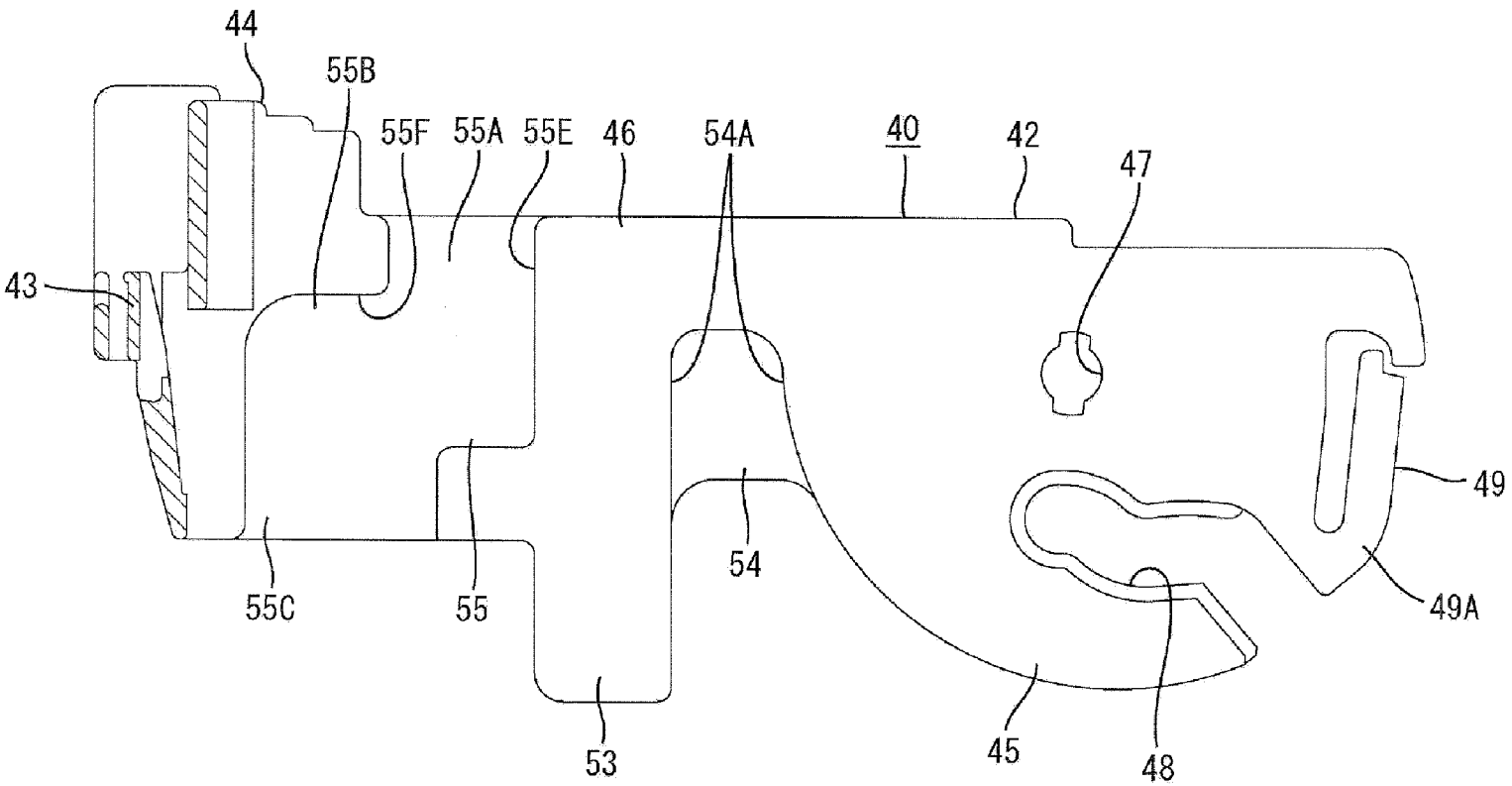
FIG. 13 is a section along B-B of FIG. 12.

The lever 40 is made e.g. of synthetic resin and has a coupling 41 and two arms 42 projecting from opposite ends of the coupling 41 so that the lever 40 is substantially U-shaped, as shown in FIGS. 12 and 13. The coupling 41 is formed with a resiliently deformable lock 43 and a substantially step-like operable portion 44 is formed at a rear end of the coupling 41.

Each arm 42 has an action portion 45 distant from the coupling 41 and a link 46 linking between the coupling 41 and the action portion 45. The action portion 45 has an arcuate outer peripheral edge and a bearing hole 47 that penetrates through an inner part of the action portion 45. A bottomless cam groove 48 extends in from the outer peripheral edge of the action portion 45. A resilient piece 49 is cantilevered along the outer peripheral edge. The resilient piece 49 has a base end 49A near the entrance of the cam groove 48 and is resiliently deformable with the base end portion 49A as a support. A first projection 50 is formed at the leading end of the resilient piece 49 and a second projection 51 at the base end, as shown in FIG. 1. Straight edges 52 are formed on the opposite front and rear end edges of the link 46 of each arm 42 and extend substantially in the width direction. The rear straight edge 52 is continuous with the action portion 45.

The lever 40 is so mounted to straddle the housing 10 from behind and is rotatable between an initial position IP and a connection position CP about the shafts 20 with the shafts 20 fit into the bearing holes 47. The coupling 41 is distant from and behind the housing 10 at the initial position IP and the rear straight edges of the arms 42 are oblique to the rear end edge of the housing 10 (see FIG. 4). The coupling 41 is near an end surface of the housing 10 at the connection position CP and the rear straight edges 52 of the arms 42 are substantially parallel to the rear edge of the housing 10 (see FIG. 5). Further, the arms 42 face the outer surfaces of the long walls 12 of the housing 10 when the lever 40 is at the connection position CP. The lever 40 is mounted to only the right shafts 20 on each long side wall 12 in FIGS. 4 and 5, and the other shafts 20 are not used. This is because the housing 10 has a rear end portion structure common to another unillustrated housing sharing the mating housing 100 and can be formed by the same mold. Thus, the lever 40 for the other housing is supported on shafts at the other end and is rotated in a direction opposite to the above.

A projecting piece 53 projects forward from the front end edge of each link 46. The projecting piece 53 is a substantially rectangular plate and is thinner than the action portion 45. Further, a bottomed recess 54 is formed in the inner surface of the link 46 of each arm 42 and opens at the front end edge. The recess 54 has opposite widthwise sides defined by an edge 54A that extends substantially continuously from one widthwise edge of the projecting piece 53 and also from the outer peripheral edge of the action portion 45.

A guide path 55 is formed in the inner surface of the link 46 of each arm 42 for guiding a displacement of the cover 70 relative to the housing 10. The guide path 55 is a bottomed groove extending substantially in the height direction and opens at the opposite front and rear end edges of the link 46. Specifically, the guide path 55 comprises an assembly guiding portion 55A arranged at a position near the coupling 41 and extending substantially straight forward from the rear end edge of the link 46, a slide permitting portion 55B extending from the front end of the assembly guiding portion 55A toward the coupling 41 and a mold removing portion 55C extending forward from an end of the slide permitting portion 55B closest to the coupling 41 to the front end edge of the link 46. An entrance 55D of the assembly guiding portion 55A for receiving the cover 70 is formed at the rear end edge of the link 46. The assembly guiding portion 55A is narrower than the slide permitting portion 55B and the mold removing portion 55C. The assembly guiding portion 55A and the mold removing portion 55C overlap each other in the width direction, and the entrance 55D of the assembly guiding portion 55A is located near the operable portion 44. A substantially L-shaped first edge 55E is defined by an edge of the assembly guiding portion 55A at one widthwise side and the front end edge of the slide permitting portion 55B, and a substantially L-shaped second edge 55F is defined by an edge of the assembly guiding portion 55A at the other widthwise side and the rear end edge of the slide permitting portion 55B.

The cover 70 is made e.g. of synthetic resin and is substantially cap-shaped, as shown in FIGS. 6 to 9. The cover 70 is slidable along the rear end edge of the housing 10 in a sliding direction SD that is substantially orthogonal to the connecting direction. The cover 70 is at a standby position SP before a sliding movement and has one widthwise end projecting out at one widthwise side of the housing 10 (see FIG. 2). The cover 70 then can be slid to a mount position MP so that the cover 70 is accommodated substantially entirely within the width of the housing 10 (see FIG. 3).

The cover 70 includes a narrow restricting plate 71 that is long in the width direction and that faces the rear end surface of the housing 10 while being spaced therefrom. Two side plates 72 project forward from the opposite lateral edges of the restricting plate 71 and are spaced apart in the height direction. An end plate 73 is connected to the side plates 72 and the restricting plate 71 at the other widthwise side. The restricting plate 71 is substantially U-shaped in section and defines a draw-out direction of the wires 200 toward one widthwise side and hence substantially orthogonal to the connecting direction. A substantially U-shaped wire draw-out opening 74 is defined by one widthwise end edge of the restricting plate 71 and edges of the side plates 72. The end plate 73 is curved forward and includes a substantially U-shaped escape opening 75 at the front end edge of the cover 70. An opening area of the escape opening 75 is smaller than that of the wire draw-out opening 74, but most of the end plate 73 is cut off by the escape opening 75. Note that the coupling 41 passes at an outer side of the other widthwise end of the end plate 73 in the process of rotating the lever 40.

Left and right cover slides 76F, 76R project out from each side plate 72 the opposite left and right and rear ends of the respective side plate 72 in the sliding direction SD of the cover 70. Thus, the respective cover slides 76F, 76R are arranged at four corners and are spaced apart on the front end edge of the cover 70. The respective cover slides 76F, 76R define legs 77 in the form of rectangular plates.

The left cover slides 76F are connected to the outer surfaces of the side plates 72 via steps. A bottomed left slide groove 76G is formed in the inner surface of a leading end of each left cover slide 76F and opens to the left in the forward sliding direction. The left slide groove 76G is defined by a wall surface that is substantially L-shaped in section. The left housing slides 22F slidably fit into the left slide grooves 76G, and the back ends of the left slide grooves 76G define stopper edges 76H that the left housing slides 22F contact in the sliding direction SD.

The right cover slides 76R are substantially continuous with ribs 78 that extend in the height direction on the outer surfaces of the side plates 72. A laterally extending bottomed right slide groove 76S is formed in the inner surface of a leading end portion of each right cover slide 76R and opens in the width direction. The right slide groove 76S is defined by a wall surface that is substantially crank-shaped in section and includes the front end edge of the side plate 72. The right housing slides 22R fit slidably into the right slide grooves 76S, and the back ends of the right slide grooves 76S define stopper edges 76T that the right housing slides 22R contact in the sliding direction SD.

A resiliently deformable cover lock 79 projects forward at the right widthwise end of each side plate 72 and behind the right cover slide 76R in the sliding direction SD. The cover lock 79 is arranged substantially side by side with the right cover slide 76R and a slit 80 extends in the height direction between the cover lock 79 and the right cover slide 76R. The second locks 79 and the cover slides 76F, 76R form the legs 77.

A lock projection 81 projects from the inner surface of each cover lock 79. A first guide surface 81A is defined at the left side of the lock projection 81 inclines out toward the rear in the sliding direction SD. A second guide surface 81B is defined at the front of the lock projection 81 in the assembling direction onto the housing 10 and inclines out toward the rear side relative to the assembling direction onto the housing 10. An angle of inclination of the second guide surface 81B is steeper than the first guide surface 81A.

Spaces 60 are defined between the front end edge of the cover 70 and the rear end edge of the housing 10 with the cover 70 properly mounted on the housing 10 and the wires 200 are arranged while being exposed to the spaces 60. In other words, the spaces 60 are arranged between the respective legs 77. Specifically, the space 60 at the right side (rear side in the sliding direction) defines an inner space of the wire draw-out opening 74, the one at the left side (front side in the sliding direction) defines an inner space of the escape opening 75, and the spaces 60 between the legs 77 adjacent in the width direction (hereinafter, referred to as "widthwise spaces 60A") are narrow slit-like spaces long in the width direction.

Figure 2:
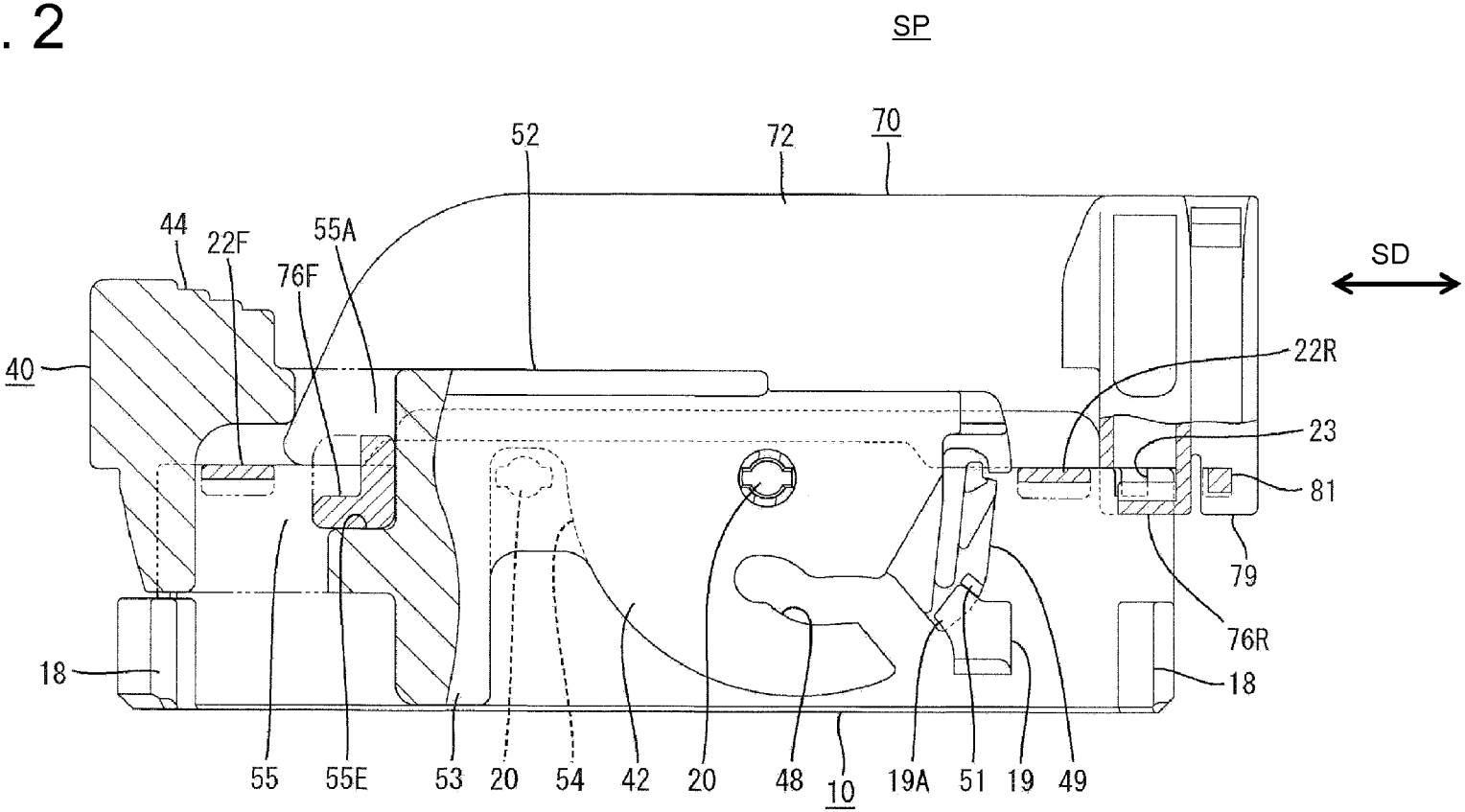
FIG. 2 is a plan view partly in section showing a state where the cover is mounted at a standby position.

The lever 40 is mounted on the housing 10 before the cover 70 is mounted on the housing 10 and is left at the connection position CP. At this time, the second projections 51 of the resilient pieces 49 resiliently engage with the hooking pieces 19A of the hooks 19 to prevent rotation of the lever 40 to the initial position IP and the front end edge of the coupling 41 is held in contact with the protrusions 18 to prevent any further forward movement of the lever 40. The rear straight edges 52 of the arms 42 project slightly back from the rear end edge of the housing 10 when the lever 40 is at the connection position CP and the entrances 55D of the assembly guides 55A of the guide paths 55 are open backward at these straight edges 52 as shown in FIG. 1. In this state, the left cover slides 76F are inserted into the entrances 55D of the assembly guiding portions 55A and the cover 70 is displaced or pulled forward toward the standby position SP. In the inserting process, the left cover slides 76F are fit loosely into the assembly guides 55A and slid along the second edges 55E (may be the first edges 55F) of the assembly guiding portions 55A to guide an assembling operation of the cover 70. When the assembling is completed, the left cover slides 76F contact the first edges 55E of the slide permitting portions 55B, as shown in FIG. 2, to prevent any further forward displacement of the cover 70. Thus, the cover 70 is temporarily stopped or positioned at the standby position SP.

The cover 70 is moved substantially parallel with the rear end edge of the housing 10 as the left cover slides 76F are displaced. Alternatively, in a state where the left cover slides 76F are held in contact with corners of the first edges 55E while the one widthwise side of the cover 70 is lifted from the housing 10, the cover 70 may be rotated about the contact position to bring the one widthwise side toward the housing 10. Further, in the assembling process, the second guide surfaces 81B of the lock projections 81 slide in contact with the respective wires 200 drawn out from the rear end surface of the housing 10 in the assembling direction so that resistance between the lock projections 81 and the respective wires 200 is reduced to ensure a smooth assembling operation of the cover 70.

At the standby position SP, the respective cover slides 76F, 76R are arranged to the right of the corresponding housing slides 22F, 22R and the lock projections 81 of the respective second locks 79 are arranged at the right sides of the corresponding first locks 23. Further, at the standby position SP, the left housing slides 22F and the left cover slides 76F are hidden inside the arms 42 of the lever 40, whereas the right housing slides 22R, the right cover slides 76R and the second locks 79 are visible from the outside. Furthermore, at the standby position SP, the respective wires 200 enter the escape opening 75 to be led out.

In the above state, the cover 70 is displaced left toward the mount position MP. Then, the left housing slides 22F slide on the groove surfaces of the left slide grooves 76G of the left cover slides 76F to engage the left cover slides 76F and the right housing slides 22R slide on the groove surfaces of the right slide grooves 76S of the right cover slides 76R to engage the right cover slides 76R. Thus, the cover 70 is guided to the mount position MP in a well-balanced manner. In this sliding process to the mount position MP, the respective wires 200 face the spaces 60, particularly the widthwise spaces 60A. Therefore, the respective wires 200 will not be caught between the front end edge of the cover 70 and the rear end edge of the housing 10. Further, in the sliding process, the left cover slides 76F enter the slide permitting portions 55B of the guide paths 55 to be let out.

Figure 3:
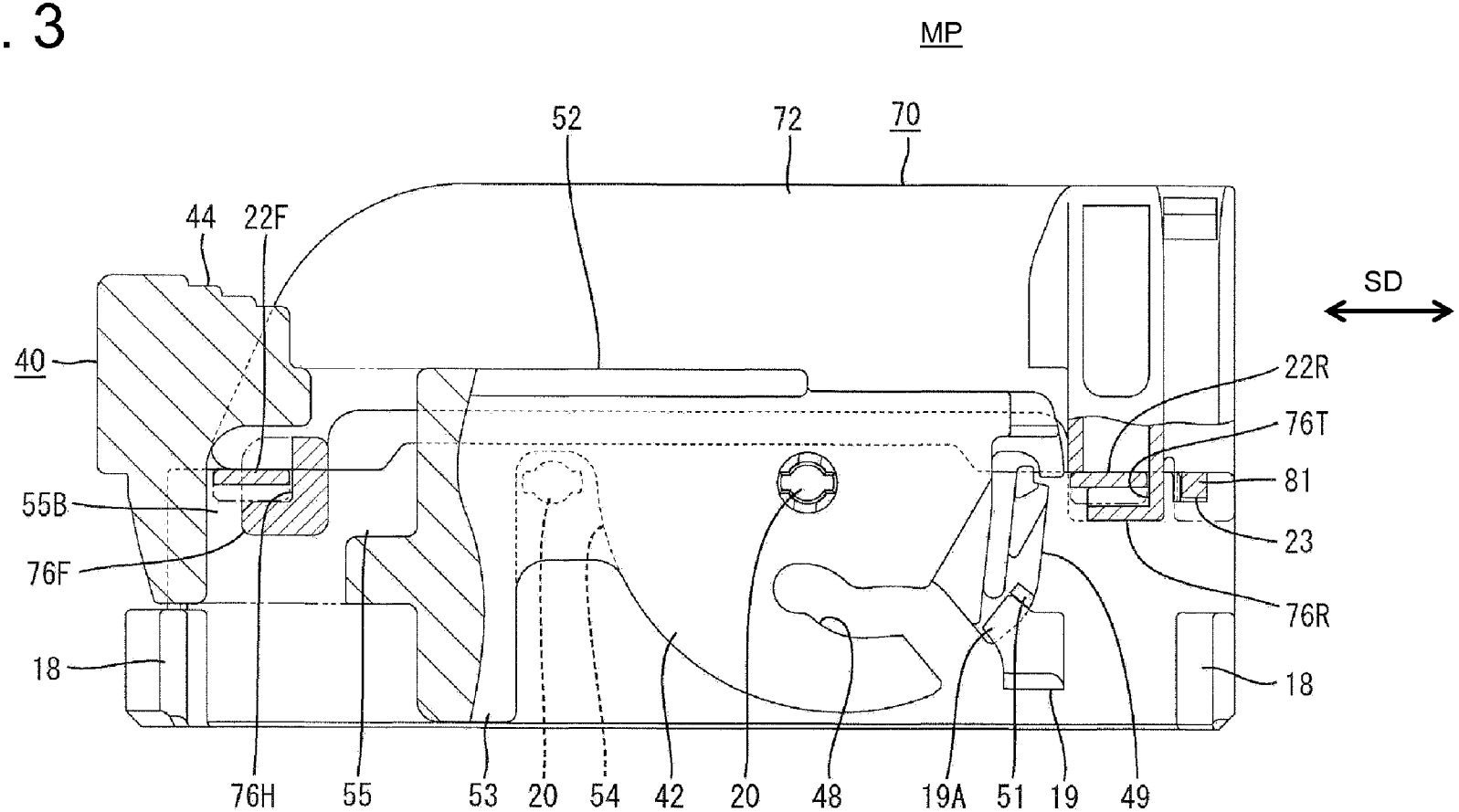
FIG. 3 is a plan view partly in section showing a state where the cover is mounted at a mount position.

When the cover 70 reaches the mount position MP, the left housing slides 22F contact the left stopper edges 76H of the left cover slides 76F and the right housing slides 22R contact the right stopper edges 76T of the right housing slides 22R, as shown in FIG. 3, thereby preventing the cover 70 from being displaced any further. The lock projections 81 of the second locks 79 are fit resiliently into the first locks 23 when the cover 70 reaches the mount position MP to prevent detachment of the cover 70 toward the right or rear in the sliding direction SD. Further, the right housing slides 22R are kept fit in the right cover slides 76R and the left housing slides 22F are kept fit in the left cover slides 76F to prevent loose forward and/or backward movements of the cover 70 relative to the housing 10. In the mounting process of the cover 70 to the mount position MP, the first guide surfaces 81A of the lock projections 81 slide on both corners of the right side of the housing 10 and the second locks 79 deform resiliently out. The second locks 79 restore resiliently as the lock projections 81 fit into the first locks 23. At the mount position MP, the cover 70 and the housing 10 are connected only by the respective legs 77 and the remaining parts are open as the spaces 60.

Figure 4:
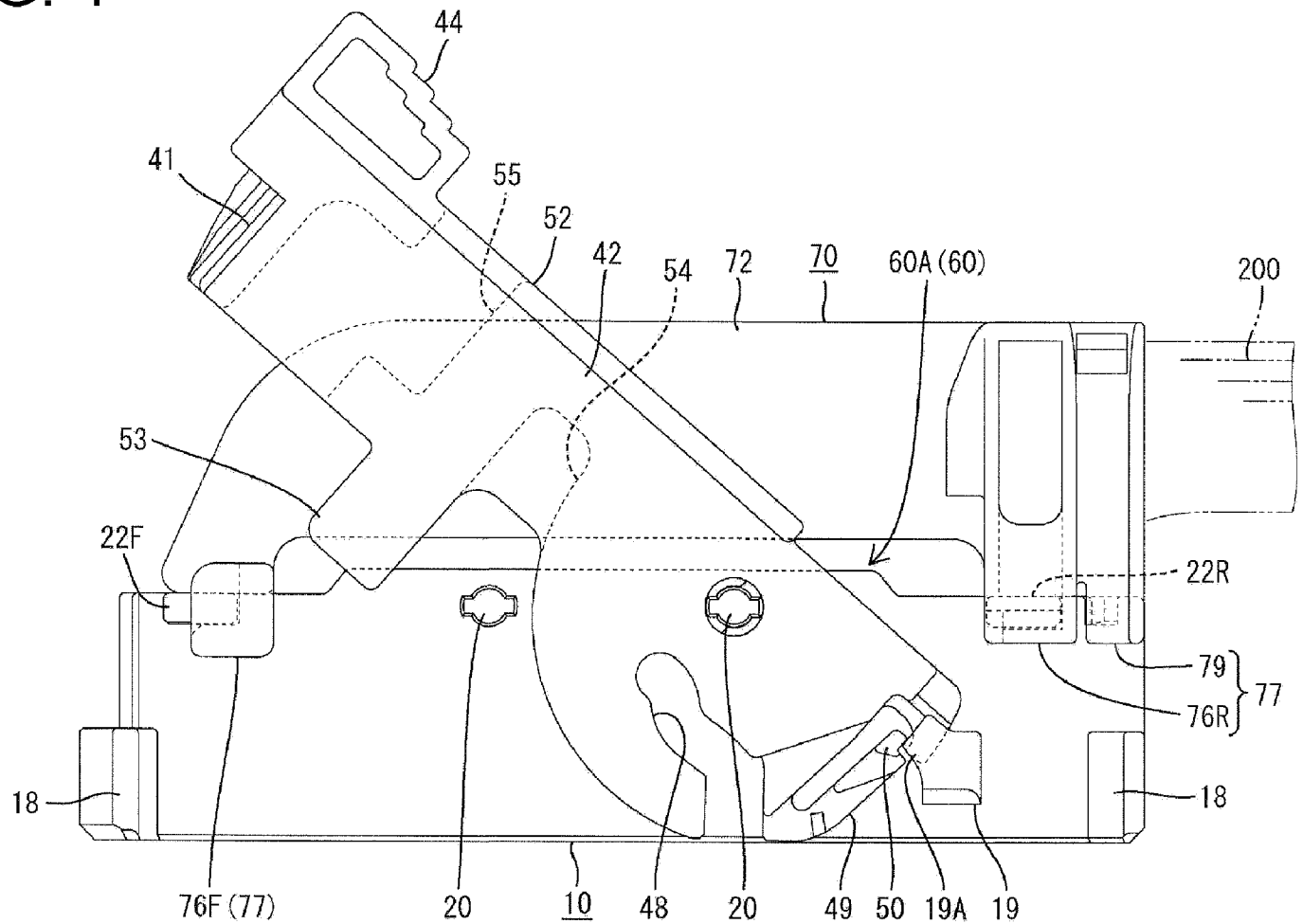
FIG. 4 is a plan view showing a lever at an initial position.

Subsequently, the lever 40 is displaced by gripping the coupling 41. At this time, the second projections 51 and the hooking pieces 19A disengage easily since they are engaged lightly with each other. The first projections 50 of the resilient pieces 49 resiliently engage the hooking pieces 19A as shown in FIG. 4 when the lever 40 reaches the initial position IP to prevent rotation of the lever 40 to the connection position CP. At the initial position IP, the entrances of the cam grooves 48 of the lever 40 are open forward and corners of the leading ends of the projections 53 are located at outer sides of the bulges 21 of the housing 10. Thus, the wires 20 are accommodated inside the projections 53 and cannot project out and the projecting pieces 53 cannot incline. Furthermore, at the initial position, the respective wires 200 can be seen through the spaces 60.

The housing 10 then is fit lightly into the receptacle 110 of the mating housing 100. Thus, the cam followers 113 at the one widthwise side enter the cam grooves 48 and the first projections 50 and the hooking pieces 19A are disengaged by the mating housing 100. In this state, the operable portion 44 is pushed forward to rotate the lever 40 toward the connection position CP. In the displacement rotating process of the lever 40, the cam followers 113 slide along the groove surfaces of the cam grooves 48 so that a cam action is displayed between the lever 40 and the mating housing 100 for connecting the two housings 10, 100 with a low operation force. The lock 43 resiliently engages the engaging portion 112 when the lever 40 reaches the connection position CP, as shown in FIG. 5. Thus the lever 40 is held on the mating housing 100 so as not to be displaced and the housing 10 is held in a connected state. At the connection position CP, the respective male tabs are inserted through the tab insertion holes 15 and connected electrically to the corresponding female terminal fittings at proper depths. Further, at the connection position CP, the widthwise spaces 60A particularly are closed by the rear ends of the arms 42 and it becomes practically impossible to see the wires 20 through the spaces 60A. Furthermore, at the connection position CP, the shafts 20 at the widthwise side that are not supporting the lever 40 are inserted into the recesses 54 of the arms 42 and the cam followers 113 at the other widthwise side that are not inserted into the cam grooves 48 are inserted into constricted parts between the projections 53 and the action portions 45, thereby avoiding interference of the shafts 20 and the cam followers 113 with the lever 40.

The cover 70 is positioned and guided by the guiding portion and is set to the standby position SP without problem before the sliding movement of the cover 70 is started. Thus, the cover 70 can be assembled smoothly.

The left cover slides 76F are guided while sliding along the guide paths 55, and thus perform both functions of assembling and slide guiding the cover 70. Thus, the construction of the cover 70 is simplified.

The assembling direction of the cover 70 is guided by the assembly guiding portions 55A of the guide paths 55 and the sliding direction of the cover 70 from the standby position SP to the mount position MP are at an angle, preferably substantially orthogonal to each other. Thus, the cover 70 is not brought to the mount position MP at once and the wires 200 are prevented from being caught between the cover 70 and the connector member.

The guide paths 55 are formed in the lever 40. Thus, a degree of freedom in the construction of the housing 10 is increased.

The guide paths 55 are formed by recessing the inner surfaces of the arms 42 of the lever 40 and the left cover slides 76F of the cover 70 are guided while sliding along both guide paths 55. Thus, the cover 70 can be guided in a well-balanced manner.

When the lever 40 is at the connection position CP, the rear end edges of the arms 42 project from the rear end edge of the housing 10 and the entrances 55D of the assembly guides 55A of both guide paths 55 are open at the rear end edges of the arms 42. Thus, the cover 70 is positioned and guided at an initial stage before the cover 70 is engaged with the housing 10 so that a guiding function is improved further.

The left cover slides 76F are hidden inside the lever 40 when the lever 40 is at the connection position CP. Thus, it would be difficult to confirm visually whether the cover 70 has reached the standby position SP or the mount position MP and how far the cover 70 has been slid toward the mount position MP if the cover had only of the left cover slides 76F. However, according to this embodiment, the right cover slides are arranged to be visible from the outside of the cover 40 when the lever 40 is at the connection position CP. Thus, a current position of the cover 70 can be detected by visually confirming a positional relationship of the right cover slides 76R and right housing slides 22R.

The spaces 60 are defined between the respective legs 77 for exposing the wires 200 drawn out from the rear end surface of the housing 10 with the cover 70 mounted on the housing 10. Thus, the respective wires 200 cannot be caught between the cover 70 and the housing 10.

The construction of the housing 10 is simplified because the legs 77 are formed on the cover 70.

The legs 77 include the cover slides 76F, 76R. Thus, the construction is simpler as compared with the case where the cover slides 76F, 76R and the respective legs 77 are formed separately.

The widthwise spaces 60A particularly are covered by the arms 42 at the connection position CP where the coupling 41 of the lever 40 is near the housing 10. Thus, foreign matter cannot easily enter into the spaces 60A.

The invention is not limited to the above described and illustrated embodiment. For example, the following embodiments are also included in the scope of the invention.

The guide paths may be formed in the housing. In this case, the lever may not be mounted on the housing.

The assembling direction of the cover and the sliding direction of the cover from the standby position to the mount position may cross without being orthogonal to each other.

The slide permitting portion and the mold removing portion may be omitted from the guide path.

It is sufficient for the cover to include at least the restricting plate.

The legs may be formed on the housing.

What is claimed is:

1. A connector, comprising:

a housing including a wire draw-out surface from which at least one wire is to be drawn out;

a restriction to be mounted on the housing and including a restricting plate at a position substantially facing the wire draw-out surface for specifying a draw-out direction of the wire; and legs formed on a peripheral portion of one of the restriction and the housing while projecting toward the other, spaces being defined between the legs with the restriction mounted on the housing for exposing the wire drawn out from the wire draw-out surface.

2. The connector of claim 1, wherein the legs are formed on the restriction.

3. The connector of claim 1, wherein the restriction is mounted on the housing slidably in a direction substantially along the wire draw-out surface.

4. The connector of claim 3, wherein the restriction and the housing respectively are formed with slides that slide together while preventing the restriction and the housing from being detached from each other when the restriction is mounted slidably mounted.

5. The connector of claim 4, wherein the slides are on the legs.

6. The connector of claim 1, further comprising a U-shaped movable member having a coupling and two arms projecting from the coupling, the movable member being to be mounted to straddle the housing.

7. The connector of claim 6, wherein the housing is connected to a mating housing by displacing the movable member.

8. The connector of claim 7, wherein the spaces between the legs adjacent in a width direction are covered by the arms when the coupling comes close to the housing.

9. The connector of claim 6, wherein guide paths for guiding a displacement of the restriction relative to the housing is formed on an inner surface of the arm.

10. The connector of claim 9, wherein the guide path comprises:

an assembly guiding portion arranged at a position near the coupling and substantially extending substantially straight forward from the rear end edge of a link of the arm, a slide permitting portion extending substantially from the front end of the assembly guiding portion toward the front side in the sliding direction of the restriction and a mold removing portion substantially extending forward from an end of the slide permitting portion at an opposite widthwise side to the front end edge of the link, wherein the assembly guiding portion and the mold removing portion overlap each other in the width direction.

11. A connector, comprising:

a housing including a front surface for connection with a mating housing and a rear surface from which at least one wire is to be drawn out; and a cover mounted on the housing and including a restricting plate at a position substantially facing the rear surface of the housing for specifying a draw-out direction of the wire, legs formed on a peripheral portion of the cover and projecting toward the housing, spaces defined between the legs with the cover mounted on the housing for exposing the wire drawn out from the rear surface; and a U-shaped lever having a coupling and two arms projecting from the coupling, the lever being mounted to straddle the housing, the arms having cam grooves engageable with the mating housing for connecting the housing to the mating housing by displacing the lever.

12. The connector of claim 11, wherein the cover is mounted on the housing slidably in a direction substantially along the rear surface.

13. The connector of claim 12, wherein the cover and the housing respectively are formed with slides that slide together while preventing the cover and the housing from being detached from each other when the cover is mounted slidably mounted.

14. The connector of claim 13, wherein the slides are on the legs.

15. The connector of claim 11, wherein the spaces between the legs adjacent in a width direction are covered by the arms during at least certain ranges of movement of the lever.

* * * * *